US006234322B1

(12) United States Patent
Paladin

(10) Patent No.: US 6,234,322 B1
(45) Date of Patent: May 22, 2001

(54) ROLLER DEVICE TO SEPARATE CHIPS AND PARTICLES OF WOOD OR MATERIAL SIMILAR TO WOOD OF DIFFERENT GRADINGS, AND THE RELATIVE FORMING MACHINE EMPLOYING THE DEVICE

(75) Inventor: Romeo Paladin, Oderzo (IT)

(73) Assignee: PAL Srl, Ponte di Piave (IT)

( * ) Notice: Subject to any disclaimer, the term of this patent is extended or adjusted under 35 U.S.C. 154(b) by 0 days.

(21) Appl. No.: 09/380,763

(22) PCT Filed: Mar. 5, 1998

(86) PCT No.: PCT/IB98/00285

§ 371 Date: Sep. 13, 1999

§ 102(e) Date: Sep. 13, 1999

(87) PCT Pub. No.: WO98/40173

PCT Pub. Date: Sep. 17, 1998

(30) Foreign Application Priority Data

Mar. 12, 1997 (IT) ..... UD97A0046

(51) Int. Cl.[7] ..... B07B 13/05

(52) U.S. Cl. ..... 209/667; 209/668; 209/517; 209/659; 209/660; 209/670; 209/671; 209/672

(58) Field of Search ..... 209/517, 659, 209/660, 667, 668, 670, 671, 672; 193/37

(56) References Cited

U.S. PATENT DOCUMENTS 1,173,737 * 2/1916 Quesnell .
4,364,479 * 12/1982 Sardo ..... 209/668
4,405,050 * 9/1983 Fenton, Jr. et al. ..... 209/668
5,109,988 * 5/1992 Artiano ..... 209/673
5,887,515 * 3/1999 Kunstmann et al. ..... 100/39

FOREIGN PATENT DOCUMENTS

95784 * 5/1897 (DE) .

* cited by examiner

*Primary Examiner*—Donald P. Walsh
*Assistant Examiner*—Mark J Beauchaine
(74) *Attorney, Agent, or Firm*—Antonelli, Terry, Stout & Kraus, LLP

(57) ABSTRACT

Device incorporating rollers to separate particles of different gradings a plurality of adjacent rollers (11) forming a selection bed where each roller (11) has a surface conformation defining a plurality of circumferential peaks (12) alternating with circumferential grooves (13), the rollers (11) including at least a working position where the grooves (13) of one roller are facing and at least partly penetrated by the peaks (12) of the adjacent roller (11), the discharge gap (18) between the two adjacent rollers (11) having a substantially zig-zag development, in at least some rollers (11) the connection surface (26) between the peaks (12) and grooves (13), and/or the peaks (12) and/or the grooves (13) themselves being at least partly worked with protuberances, protrusions, hollows and/or facets (23, 24, 25).

17 Claims, 6 Drawing Sheets

ROLLER DEVICE TO SEPARATE CHIPS AND PARTICLES OF WOOD OR MATERIAL SIMILAR TO WOOD OF DIFFERENT GRADINGS, AND THE RELATIVE FORMING MACHINE EMPLOYING THE DEVICE

FIELD OF THE INVENTION

This invention concerns a device with rollers to separate chips and particles of wood or material similar to wood of different gradings, and also the forming machine employing the said roller device, as set forth in the respective main claims.

The invention is applied in machines employed to select chips and particles according to their grading from a loose mass in the form of chips, shavings, fibres, granules etc., in order to then use the material, separated according to the different gradings, in the same machines.

To be more exact, the invention is applied to a separating device with a bed of rollers employed as a screen for chips, particles or fibres, of wood or material similar to wood, to be used by the said machine or to be sent to other processing, for example to refining processes for those parts not suitable for gravimetric selection, to gluing processes or other desired processes.

The invention is also applied to forming machines suitable to select the material according to its grading size and deposit it in super-imposed layers, each having its own range of different gradings; the layered mat thus formed is then generally sent to a pressing process to produce panels of wood or material similar to wood.

BACKGROUND OF THE INVENTION

For some time the state of the art has included screening devices to separate and select chips and particles according to their gradings from a loose or fibrous mass, whether it be dry or wet, generally but not exclusively of wood-based material.

Although the state of the art covers separating devices incorporating rollers, comprising adjacent rollers which rotate in the same direction and which define a bed on which the material to be selected is fed, in the past, and in the industrial field there was a large-scale preference to use screens of the type with a vibrating or oscillating netting, or also with rotary disks.

Within the range of these devices, screens with netting or with disks have been developed with one or more levels or orders of selecting elements; screens with netting or with disks using respectively meshes or gaps where the passage area is progressively increased, or also screens with netting or a disk with transverse bands, where the opening distance is progressively increased in order to discharge particles with a progressively increasing grading.

It is only in recent times that the use of screens and forming machines incorporating rollers has become of considerable importance in the industrial field, especially since materials which are highly resistant to wear, such as special steels, high resistance linings, etc., have become available at a reasonable cost.

The availability of these materials with very high surface resistance and hardness has made it possible, in recent years, to produce and employ separating devices with rollers, which have a great efficiency of production, a long life, and limited or no maintenance; this has made the applications of these machines, both simple screens on one or more levels, and also forming machines, extremely advantageous.

Although the technology of roller screens has been known to the state of the art for many years, it is only in recent years that it has found a real, large-scale industrial application, for the reasons given above.

In the light of these developments, linked to the increasingly evolved types of material available, there have been trials and experimentations in the field on solutions which substantially reproduce the effects and the functions of screens with netting and with disks, though their efficiency has been increased, thanks to the natural functionality of roller devices.

The natural functionality of roller devices is shown particularly in the selection of the fine particles, since the use of rollers instead of, for example, disks mounted on disk-bearing shafts, makes it possible to accurately gauge the gaps to an extremely reduced size which is both continuous and constant.

When disks are used, in fact, the discharge gap is of a substantially rectangular shape, where the distance between the surfaces of the adjacent disk-bearing shafts determines the length of the particles to be selected, while the distance between two adjacent disks mounted on the same shaft determines the thickness of the particles to be selected.

It should however be noted that neither netting screens nor disk screens normally allow the discharge gap in the individual sections of the selection bed to be varied during the operating cycle.

The natural functionality of roller devices has the following direct, resulting advantages:

- the preferential choice of the reliefs on the surfaces of the rollers in order to obtain a more coherent screening with the chips, particles and fibres available, and with the specific desired result;
- the possibility to distance the rollers reciprocally, both on the horizontal and vertical plane, so as to vary the discharge gap even during the operating cycle, and also to adjust, if so required, the speed of rotation of the rollers, also during the operating cycle.

These features have been the object of a multitude of patents, filed at different times and at long intervals, and therefore their solutions must be considered according to what technology was available at that specific time, with particular reference to the materials available and usable in the industrial field.

For example, U.S. Pat. No. 1,424, published in 1839, already discloses a separating device, in this case for the screening of lead oxide, including adjacent rollers equipped with grooves and penetrating peaks.

U.S. Pat. No. 292,656 also discloses rollers, with mating V-shaped threads on the surface, with a sloping and substantially helical development.

However, this embodiment has the disadvantage that it progressively displaces the material to be selected in a transverse direction with respect to the direction of feed.

U.S. Pat. No. 1,173,737, published in 1916, includes a screener with parallel rollers where the rollers include grooves cooperating with the mating tapered peaks of the adjacent rollers, and where the grooves are not penetrated by the peaks but together define a constant gap through which the particles can pass, the gap being substantially perpendicular to the direction of feed of the material.

U.S. Pat. No. 4,452,694 describes a selection device consisting of a plurality of disks arranged in a line in a plurality of parallel axes forming all together a conveyor bed for the material to be selected, the material being transported in a direction substantially at a right angle to the axis of the disks.

This conveyor bed includes a feeder end on one side and a discharge end at the other.

According to this document, the peripheral surface of the disks includes disks with protrusions or tapered peaks which position themselves in a mating position with tapered recesses or grooves on the adjacent disks.

According to this document, moreover, the rotary speeds of the disk-bearing shafts can be different.

WO 86/01580 refers to selection devices used in incinerator plants. It uses rollers which have on their surfaces protruding ribs with a development substantially parallel to the axis of the relative roller; the walls of the ribs are substantially perpendicular to the roller.

The ribs of one roller face the ribs of the other roller, but do not mutually penetrate each other, so that the discharge gap is substantially linear.

U.S. Pat. No. 3,387,795 discloses a device to process fibrous material comprising a plurality of adjacent rollers which include on their circumferential surface pyramid-shaped tapered protrusions, separated by tapered grooves, the protrusions penetrating at least partly into the tapered grooves of the adjacent roller.

EP-B-328.067 discloses a roller device where the outer circumferential surface of the rollers has individual tapered pyramid-shaped protuberances, developing substantially in a spiral around the surface of the rollers and extending lengthwise, separated by tapered grooves.

The tips of the protuberances of two adjacent rollers face one another and define the discharge gap for the selected material; therefore, there is no penetration of the grooves by the protuberances. The discharge gap is substantially constant, at a right angle to the direction of feed of the material, and parallel to the axis of the rollers.

This embodiment, compared with the afore-mentioned U.S. Pat. No. 1,173,737 substantially includes the sole characteristic that its protuberances are pyramid-shaped and tapered, and this characteristic is in any case included in the afore-mentioned U.S. Pat. No. 3,387,795.

The modifications to the surfaces of the rollers and the disks make it possible to reproduce the natural and intrinsic effect of the netting screens and forming machines on the chips, thus obtaining a good decantation of the finer particles.

Another function of these surface modifications is to delay the passage of the cubic particles through the discharge gap as a result of the dynamic thrust caused by the faces of the protrusions of the counter-opposed rollers.

Moreover, the inclusion of these surface modifications brings the advantage that they do not cause the rollers to jam when the device starts off again; in effect, this makes the roller devices comparable to the netting screens where no problems are caused when the screening is stopped.

The conformation of the surface modifications known to the state of the art, together with a discharge gap at right angles to the direction of feed of the material, proved to have, when used, a plurality of disadvantages which had not been foreseen.

To be more exact, it has been seen that with rollers of the type known to the state of the art the passage of long and light fibrous particles through the discharge gap is very difficult.

In fact, it is very difficult for fibrous particles which are much longer than the discharge gap to pass, even if they are less thick than the discharge gap, as these long particles tend to form a bridge and therefore are not discharged through the gap.

As a result, these particles are only discharged when the gaps are much thicker than the particles themselves, and consequently also discharge short particles and cubic particles of an undesired thickness, that is to say, excessively thick.

This is an extremely serious problem for the subsequent use of the particles and substantially compromises, in many cases, the possibility of using this type of screen, particularly in forming machines, since this widening of the gap leads to cubic particles being accepted, and the latter cause an "orange peel" effect on the surface layers of the mat.

For some time the process has been known to the state of the art, namely from U.S. Pat. Nos. 3,848,741, 4,209,097, CA-A-651.347, whereby the rollers are positioned on the horizontal plane and maintained parallel, in order to vary the gap between adjacent rollers.

DE-C-2.358.022 and SU-A-1.227.263 disclose how to move one roller in alternation to the adjacent roller on the vertical plane in order to vary the gap to discharge the material.

The state of the art also covers the fact that the speed of rotation of the rollers may be adjusted.

DE-A-95 874 refers to a roller-type sizing device for materials in particle form, specifically for coal particles.

The rollers are peripherally equipped with alternate peaks and grooves, wherein the peaks of one roller face the grooves on the adjacent roller.

The peaks and grooves may be rounded, segmented or with a sharp edge.

It is also possible that the surfaces of the peaks and grooves may have channels.

This document refers to the sizing of materials which, once crumbled, take on a shape substantially of little cubes or similar, according to what is said in the first part of the description.

Moreover, the description says that among these materials a flat shape is never found.

On the contrary, due to the fibrous nature of the material, wood chips and particles tend to have an elongated shape, with a thickness much less than their length and width.

With materials derived from wood, therefore, it is usual to find a flat shape, in fact it is the most frequent shape.

Particles which are thin and have elongated fibres are more valuable, and they must be sized in a most rigorous manner.

A device such as that described in DE'874, if applied to size wood chips and particles, would not carry out its function efficiently.

In fact, as explained before, particles of wood material which are flat, fibrous and light, and much greater in length than the discharge gap, tend to form a bridge and are not discharged through the discharge gap even if their thickness is less than the width of the said gap.

Because of this shortcoming, cube-shaped particles of a greater and therefore unacceptable thickness are also accepted, together with the long fibrous particles.

Moreover, the substantially flat shape of the surface of the rollers disclosed in DE'874, even if they have channels, causes only a partial vibration of the material which is not at all sufficient for long, flat particles like wood particles, even though it may be sufficient for large, heavy particles, square or cube like particles of coal.

Furthermore, the penetration of the grooves by the peaks is only partial and limited, and not even this characteristic is suitable if referred to sizing wood-based chips or particles.

GB-A-280,191 also refers to a sizing device for particles of coal or similar, and has the same disadvantages as DE'874.

Even if the discharge gap defined by the disks is in a zig-zag, this zig-zag development is obtained with large variations of section—a phenomenon which is not very suitable to select fibrous particles and wood chips correctly and in a uniform manner.

Moreover, the protrusions on the disks perform a cutting function, which may not damage heavy, cubic particles, but considerably damages long, light particles.

Furthermore, this document does not teach to provide a sufficient vibratory effect on the particles which are to be sized, and moreover the mutually penetrating disks do not allow thin particles to be gauged.

The present Applicants, aware of the optimum functioning of screens and forming machines incorporating netting, and considering the shortcomings of the state of the art in screens and forming machines incorporating disks and rollers, have designed, tested and embodied innovative solutions to be applied to roller devices, whether they be employed with the sole function of screening, with one or more beds of rollers arranged in sequence or on several planes with a constant or progressively increasing discharge gap, and also in possible applications for roller-type forming systems.

DISCLOSURE OF THE INVENTION

This invention is set forth and characterised in the respective main claims, while the dependent claims describe variants of the idea of the main embodiment.

The purpose of the invention is to provide a device with rollers, which can be applied both to screens with one or more levels and also roller-type forming machines, the device guaranteeing an efficient and selective separation of the particles of wood or material similar to wood according to their gradings, starting from a mass of loose and/or fibrous material.

This separation substantially reproduces what can be obtained by means of screens and forming machines using netting, except that a whole series of particular advantages are added, as will be explained hereafter.

When it is used as a screen, the roller device according to the invention can be arranged on a single plane, or there can be roller devices arranged on several planes in sequence or one above the other, each one having a respective value for the relative discharge gap.

When it is used in a forming station, the roller devices according to the invention are arranged on several planes, with a different discharge gap on each plane; they cooperate at the lower part with a conveyor belt on which the layered mat is gradually formed.

According to the invention, in the case of a forming machine, the rollers of each plane or level are arranged reciprocally at a constant distance between the axes, although adjustable, so as to select particles with a defined and different grading with respect to the roller device arranged on a different level.

The material which is not selected is discharged from the terminal end of the roller device above onto the one below, and so on.

According to the invention, the surface of the rollers includes circumferential V-shaped grooves, alternating with peaks, where the grooves in one roller mate with the peaks on the adjacent roller.

In this way, each roller is substantially conformed as a plurality of adjacent, V-shaped rings keyed onto a substantially cylindrical shaft or core.

According to one embodiment of the invention, at least some of the rollers have their respective connecting surfaces between the circumferential V-shaped peaks and grooves endowed with protuberances, protrusions or other type of desired shaping or working, facing towards the outside of the plane defined by these surfaces.

According to a variant, the connecting surfaces between the peaks and grooves have hollows or facets, facing towards the inside of the roller, which may be triangular, prismatic, semi-circular or oval in shape.

According to another embodiment of the invention, along the peaks and/or grooves of the rollers, protrusions or protuberances of a triangular or prismatic section are made in a lengthwise direction.

According to a further embodiment of the invention, the peaks and grooves have a curved and/or filleted development, with protuberances and/or hollows made in correspondence with the connecting surfaces.

According to the invention, the adjacent rollers include at least a working position where the peaks of one roller penetrate the grooves of the relative adjacent roller so as to define a discharge gap with a zig-zag development with respect to the direction of feed of the material.

In the roller device according to the invention, the rollers are individually, or in groups, adjustable both on the horizontal and on the vertical plane so as to vary, in both embodiments, the discharge gap during the operating cycle too.

The inventive idea of the invention, and particularly the surface conformation of the rollers, together with the discharge gap which has a zig-zag development with respect to the direction of feed of the material, allows a plurality of advantages to be obtained.

The first advantage is that at every step of the screening cycle an efficient vibration is maintained of the loose mass fed above the bed defined by the rollers; this is due to the zig-zag route obtained also along the direction of feed. The zig-zag route is defined by the peaks which face and penetrate the grooves. It causes the material to be continuously cut and separated by the tips of the V-shaped peaks as the material advances.

Moreover, making the discharge gap not perpendicular to the direction of feed of the material assists the alignment of the longer and finer fibrous particles, and reduces the risk of these particles leapfrogging over the discharge gap because of the bridge effect.

In fact, these long particles, separated and guided by the peaks, are arranged parallel to the connecting surfaces between the peaks and grooves, and are then discharged when there is a gap comparable with their thickness.

This improved condition for selecting the long and thin particles gives a better grading selection and therefore a better gauging of the thickness of the selected particles, inasmuch as the intense vibration of the particles encourages the fine particles to be decanted towards the discharge gap, This reduces the necessity, as is often required in screens known to the state of the art, to subsequently pass the selected particles again through gravimetric selectors in order to eliminate any possible particles of too great a thickness, selected by mistake.

When the invention is used in a forming station, a considerable advantage is obtained by eliminating cubic particles from the surface layers of the mats of finished particles, and therefore by reducing the "orange peel" effect which they determine on the surface of the finished product.

This is achieved because, as we have already said, the long particles are discharged with a gap which is comparable with their thickness, and therefore, in order to discharge them, it is not necessary to widen the gap excessively, which, in devices known to the state of the art, also leads to the discharge of cubic particles onto the surface layers of the layered mat.

Moreover, the close, mutual penetration of the peaks and grooves of the adjacent rollers, creating a transit section substantially constant in width, acts as a limit to the length of the particles accepted; this length is defined by the development of the side surfaces of the peaks and grooves.

Another advantage, achieved by including a discharge gap with a zig-zag development transverse to the direction of feed of the material, is that a mat is obtained which is formed by super-imposed layers of crossed particles.

This arrangement considerably improves the mechanical characteristics of the finished panel in all its orientations.

In fact, roller-type forming machines known to the state of the art perform a random pouring of the particles or at most, with a preferential arrangement on the mat formed.

The negative result of this arrangement is that the finished product does not have a homogeneous resistance to bending; it is higher in the direction of preferential arrangement of the pouring, and lower in the non-preferential direction.

According to a variant, the screens include at least one terminal section of the type including disks.

In this embodiment, the distance between the centres of the disk-bearing shafts is adjustable so as to vary the thickness and/or the length of the particles selected, even during the operating cycle.

BRIEF DESCRIPTION OF THE DRAWINGS

The attached figures are given as a non-restrictive example, and show some preferred embodiments of the invention as follows.

DESCRIPTION OF THE INVENTION

The roller device 10 according to the invention is employed for the selection of fine particles from a loose mass.

The roller device 10 comprises a plurality of rollers 11 rotating in the same direction and arranged adjacent so as to define a discharge gap 18 of the desired value, which is adjustable.

Figure 1:
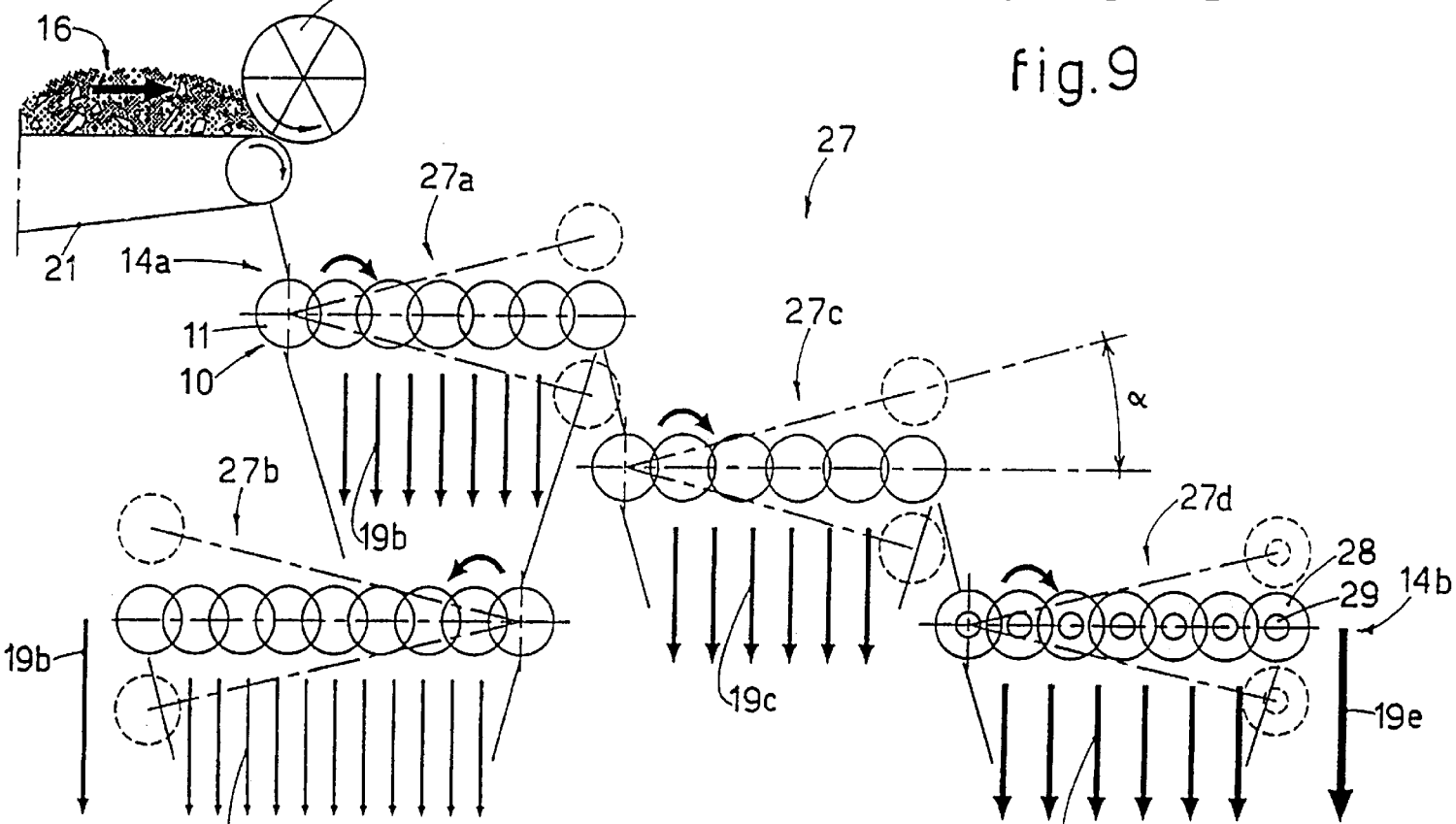
FIG. 1 shows a first form of embodiment of a screen with rollers according to the invention.
Figure 2:
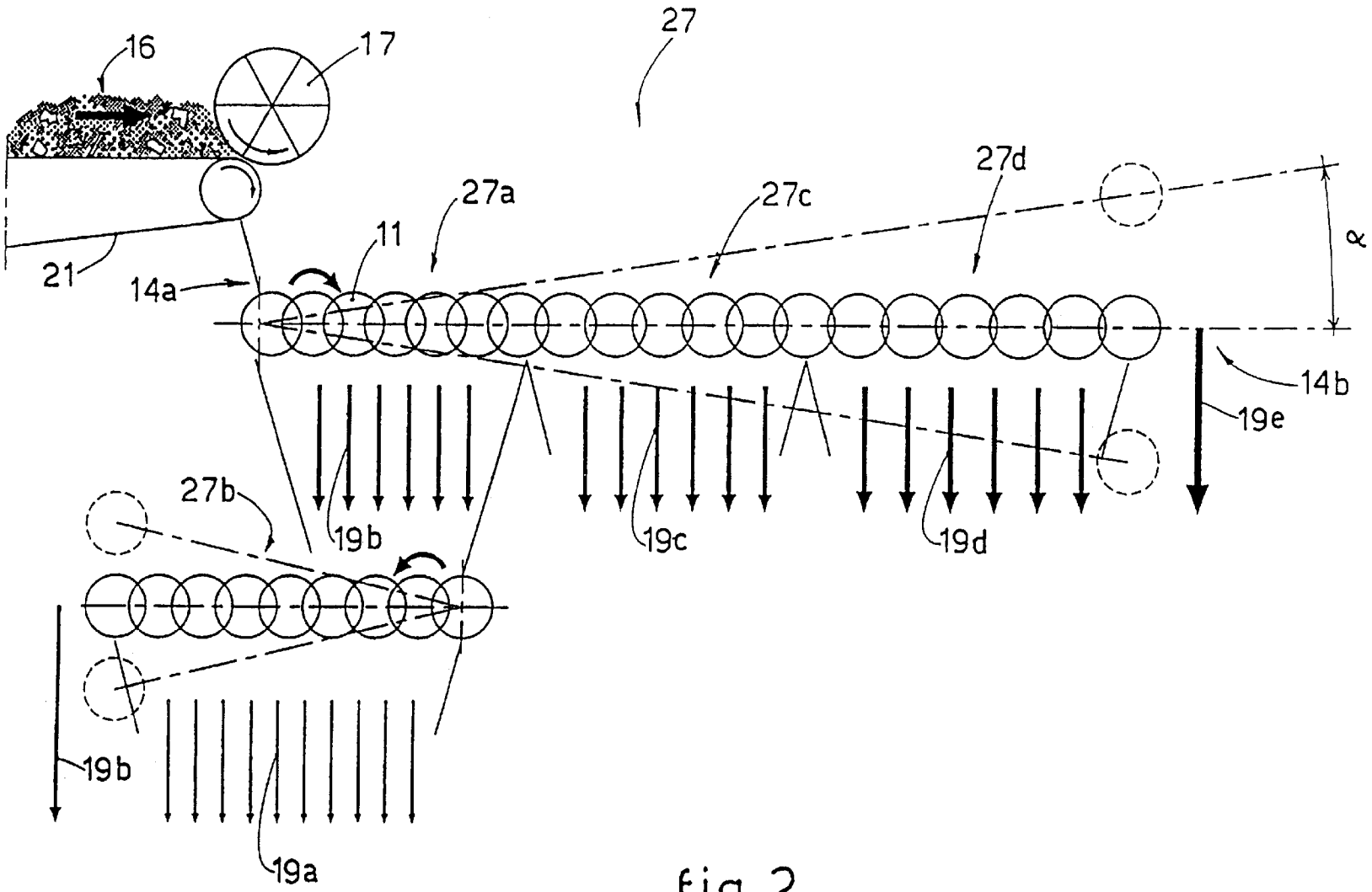
FIG. 2 shows a second form of embodiment of a screen with rollers according to the invention.
Figure 3:
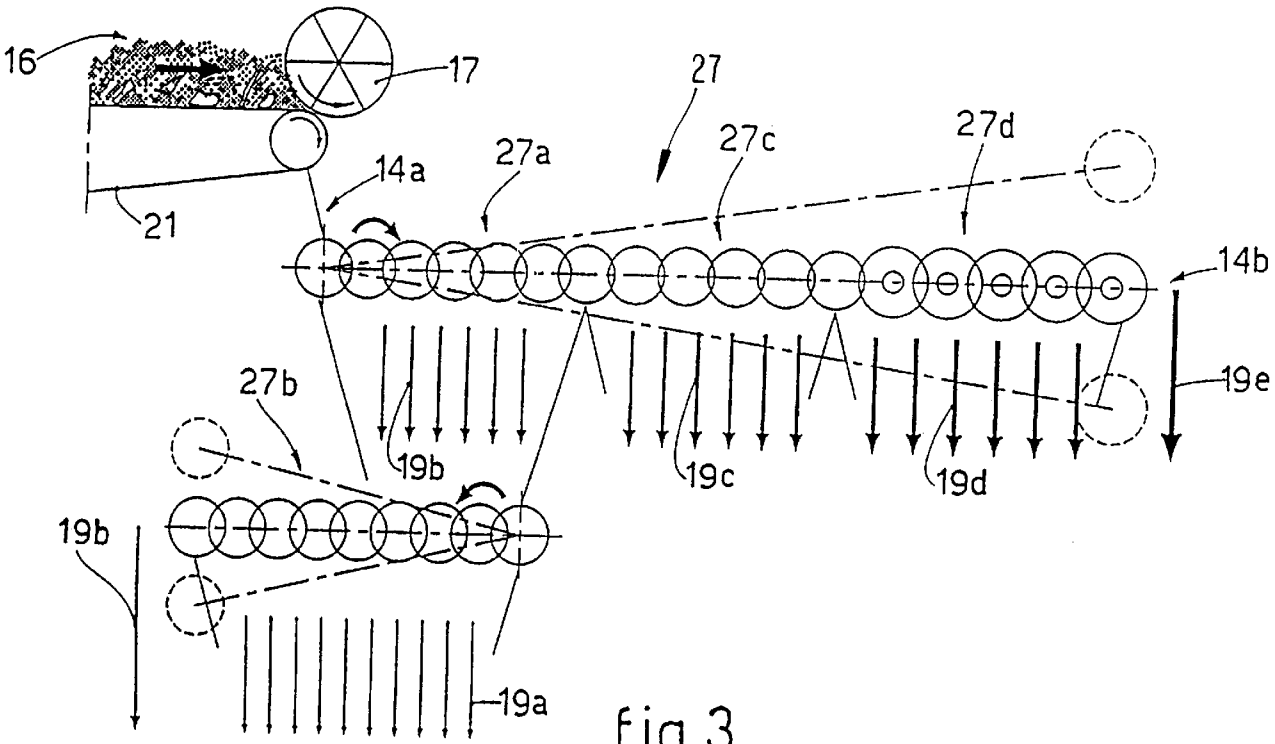
FIG. 3 shows a variant of FIG. 2.

FIGS. 1, 2 and 3 show possible applications of the invention in screens 27.

The screen 27 shown in FIG. 1 includes a feeder belt 21, or other equivalent system, to feed the loose mass 16 of material which is to be selected, the feeder belt 21 cooperating with a metering/fluidizing assembly 17.

The feeder belt 21, in correspondence with one feeder end 14*a*, discharges the material to be selected onto a first section 27*a* of the screen 27, this section 27*a* consisting of a roller device 10 characterised by its own discharge gap 18 defined by the degree of penetration between adjacent rollers 11.

The fine particles 19*b*,selected by the first section 27*a*, are discharged onto a second section 27*b,* characterised by a discharge gap 18 which is smaller than that of the first section 27*a*,in order to select particles 19*a* of the finest degree.

The particles 19*b* which are not selected by the second section 27*b* fall and are discharged at the outlet end of the second section 27*b,* and are sent to a subsequent processing step.

The particles not accepted by the first section 27*a* fall and are discharged onto the third section 27*c,* which has a discharge gap 18 greater than that of the first section 27*a*, for the selection of particles 19*c* of a greater grading.

The particles which are not selected even by the third section 27*c* fall and are discharged onto the fourth section 27*d,* which has a greater discharge gap 18, for the selection of particles 19*d* of a greater grading.

According to a variant not shown here, below the third section 27*d* there is another screening section.

The particles not accepted by this fourth section 27*d* are those with the maximum grading 19*e,* which fall and are discharged from the outlet end of the fourth section 27*d* which is also the outlet end 14*b* of the screen 27. In this case, the fourth section 27*d* is of the type with penetrating disks 28 mounted on respective disk-bearing shafts 29.

According to a variant, the third section 27*c* of the screen 27 is also of the disk type.

According to the invention, at least the distance between the centres of the disk-bearing shafts 29 can be adjusted, even during the operating cycle, so as to vary the thickness of the particles to be selected.

The respective rollers 11 or disk-bearing shafts 29 of all the sections 27*a*–27*d* of the screen 27 can be inclined on the horizontal plane (see the positions shown with a line of dashes) by an angle $\alpha$ which can have a value of as much as $\pm 30°$.

Figure 9:
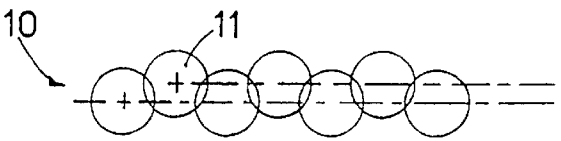
FIG. 9 shows the roller device according to the invention with the rollers distanced vertically.

Moreover, all the rollers 11 or disk-bearing shafts 29, apart from being adjustable on the horizontal plane in order to vary the distance between the centres, can be displaced with respect to each other on the vertical plane (see FIG. 9) so as to vary the discharge gap also during the operating cycle.

It is also possible to adjust the speed of rotation of the rollers 11 or the disk-bearing shafts 29, even during the operating cycle.

The variant shown in FIG. 2 differs from the embodiment shown in FIG. 1 in that the sections 27*a*, 27*c* and 27*d* are all arranged on the same horizontal plane and that section 27*d* is also of the roller type.

The further variant as shown in FIG. 3 differs from that of FIG. 2 in that the fourth section 27*d* of the screen 27 is of the disk type.

Figure 4:
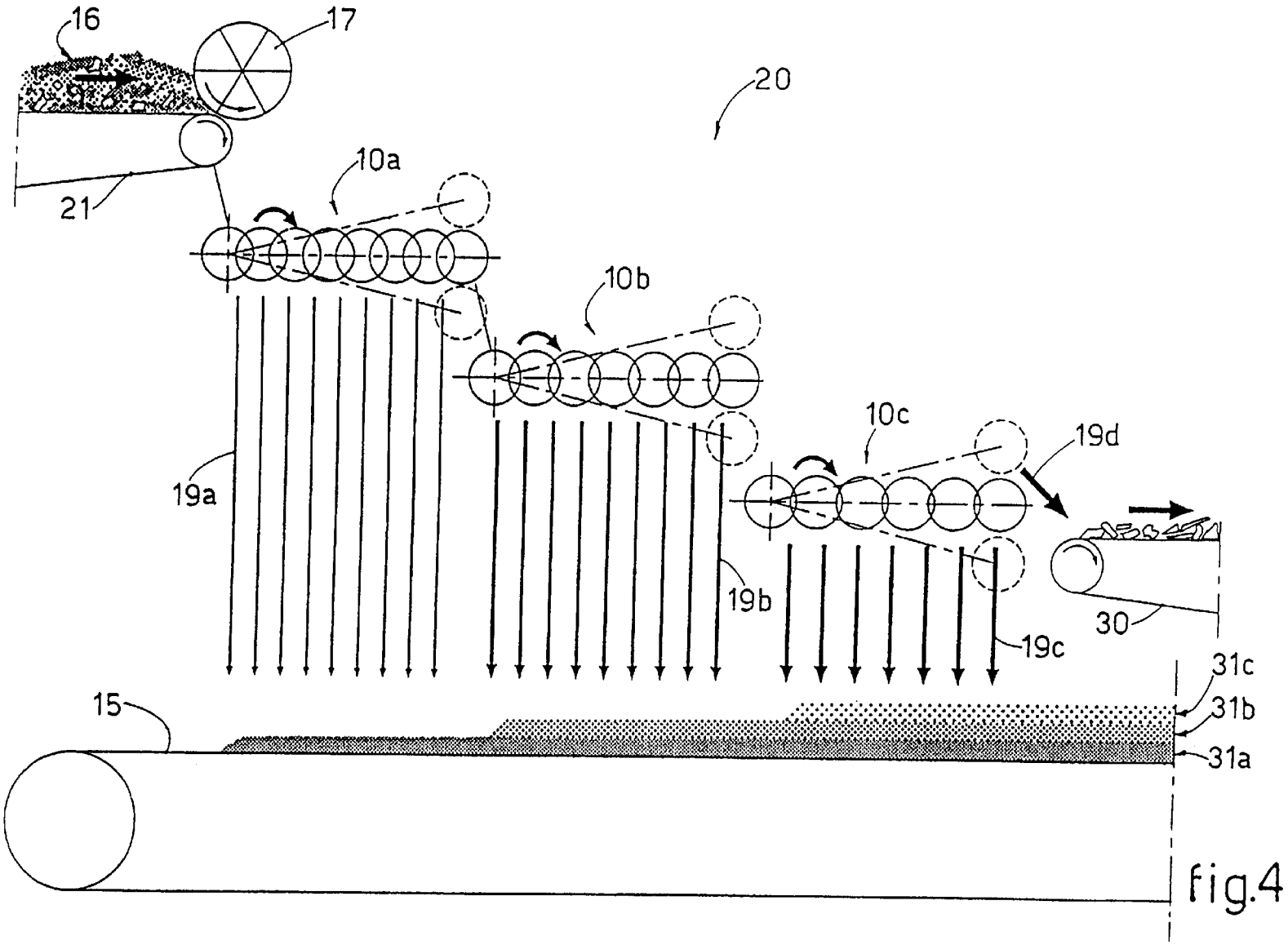
FIG. 4 shows an application of the invention in a forming station.

FIG. 4 shows an application of the invention in a forming station 20, that is, a station suitable to form, on a forming belt 15, or on any other type of equivalent movable device, a mat of particles arranged in super-imposed layers, in this case, a lower layer 31*a,* an intermediate layer 31*b,* and an upper layer 31*c,* each one characterised by its own defined range of grading.

According to a variant not shown here, the forming belt 15 is stationary and the whole forming station 20 moves.

In this case, the forming station 20 consists of three roller devices 10 according to the invention, respectively 10*a,* 10*b* and 10*c,* each one arranged on a respective plane and each one defined by its own discharge gap 18 which is constant and different from that of the other roller device 10 above or below.

The first roller device 10*a* selects fine particles 19*a* which are deposited on the conveyor belt 15 so as to form the first layer 31*a* of the mat.

The particles not accepted by the roller device 10*a* fall and are discharged onto the second roller device 10*b,* defined by a discharge gap 18 which is greater in size and which causes particles 19*b*, of a larger grading, to be accepted so as to form a second layer 31*b*.

The particles not accepted by the second roller device 10*b* are discharged onto the roller device 10*c,* defined by a discharge gap 18 which is even larger, and which causes particles 19*c,* of an even larger grading, to be accepted so as to form another layer 31*c* of the mat.

Those particles 19*d* which are not even selected by the third roller device 10*c* are discharged by means of a transporter belt 30.

Figure 5B:
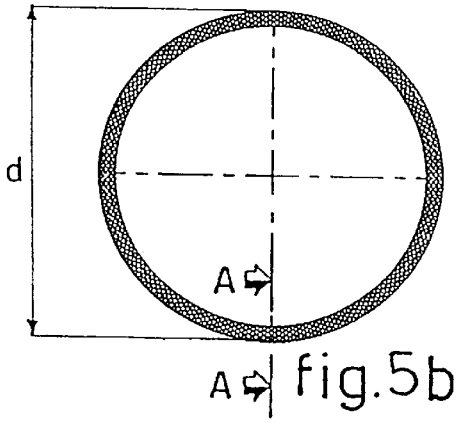
FIG. 5*b* shows a side view of a roller in FIG. 5*a;*
Figure 5A:
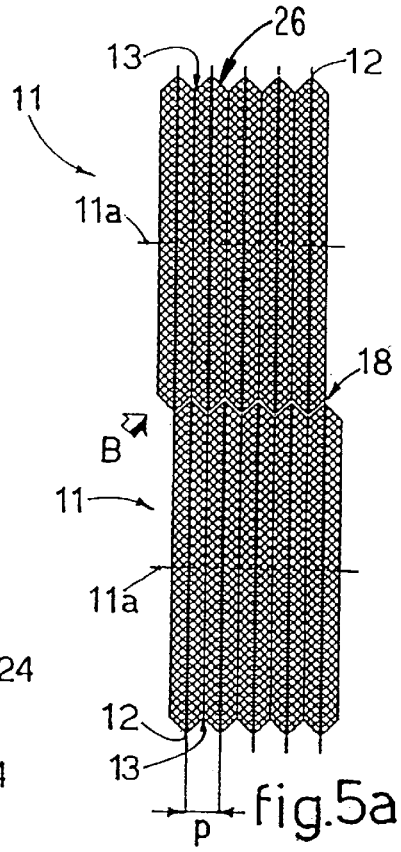
FIG. 5*a* shows two adjacent rollers in a first form of embodiment of the invention, in a part view from above.
Figure 5D:
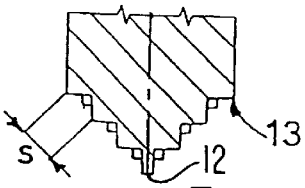
FIG. 5*d* shows a section from A to A in FIG. 5*b;*
Figure 5C:
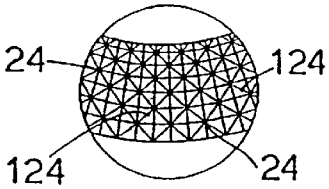
FIG. 5*c* shows the detail B in FIG. 5*a;*
Figure 6D:
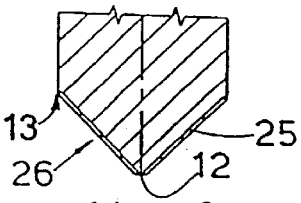
FIG. 6*d* shows a section from D to D in FIG. 6*b;*
Figure 6C:
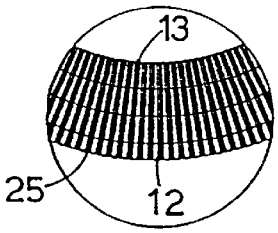
FIG. 6*c* shows the detail C in FIG. 6*b;*
Figure 6B:
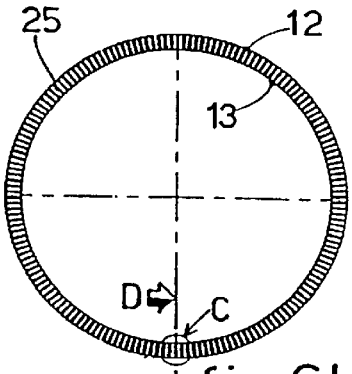
FIG. 6*b* shows a side view of a roller in FIG. 6*a;*
Figure 6A:
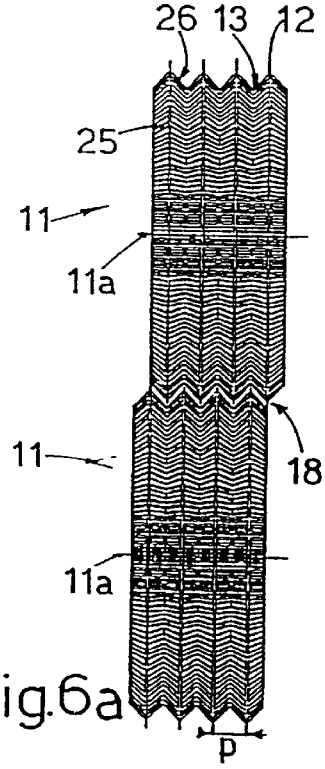
FIG. 6*a* shows a variant of FIG. 5*a;*
Figure 7D:
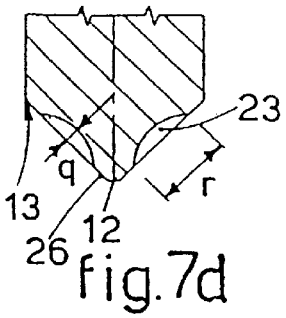
FIG. 7*d* shows a section from F to F in FIG. 7*b;*
Figure 7C:
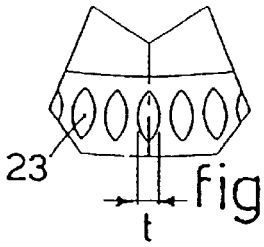
FIG. 7*c* shows the detail E in FIG. 7*b;*
Figure 7B:
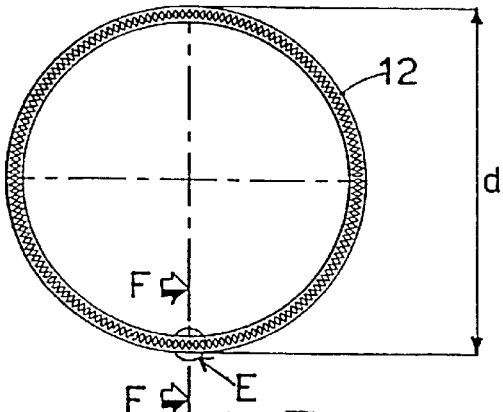
FIG. 7*b* shows a side view of a roller in FIG. 7*a;*
Figure 7A:
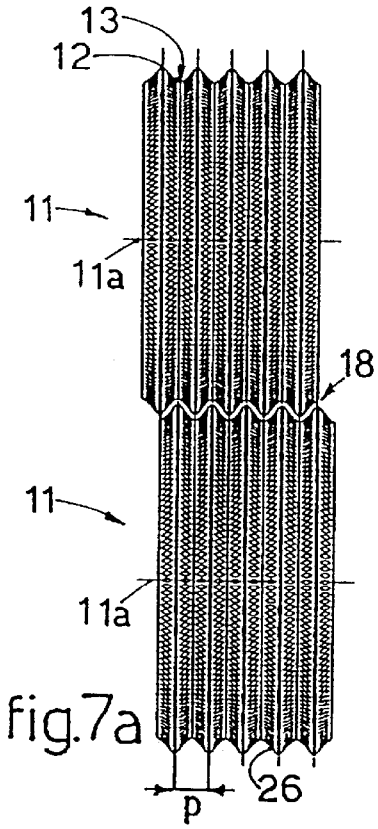
FIG. 7*a* shows another variant of FIG. 5*a;*

According to the invention (see FIGS. 5*a,* 6*a,* 7*a* and 8*a*) each. roller 11 of the roller device 10 includes on its surface an alternation of circumferential peaks 12 and grooves 13. These peaks 12 and/or grooves 13 have a sharp edge at their tip, or, according to a variant, the tip is at least filleted or rounded, as can be seen in FIG. 7*a*.

The peaks 12 and grooves 13 are arranged parallel to each other on the circumference of the relative roller 11 and extend at a right angle to the axis 11*a* of the roller 11, substantially lengthwise to the direction of feed of the material which is to be selected.

In at least one working position, the peaks 12 of one roller 11 closely penetrate the grooves 13 of the adjacent roller 11 (FIGS. 5*a,* 6*a,* 7*a,* 8*a*) in such a manner that the discharge gap 18 between the adjacent rollers 11 has a substantially zig-zag development with respect to the axis 11*a* of the relative roller 11.

The distance "p" between the tips of two adjacent peaks is inside the range of 3/4 and 1/20 of the outer diameter "d" of the relative roller 11.

In the embodiment shown in FIGS. 5*a*–5*d,* the surfaces 26 connecting the peaks 12 and the grooves 13 have pyramid-shaped protrusions 24 with a substantially square base, arranged along generation lines 124 substantially helical or radial.

The size "s" of the side of the base of the pyramid-shaped protrusions 24 is inside the range of 1/40 and 1/10 of the outer diameter "d".

In the variant shown in FIGS. 6*a*–6*d,* the connecting surfaces 26 have raised parts shaped like a parallelepipedon or prism 25, aligned along one (FIG. 6*a*) or more circumferential orders (FIGS. 6*c*, 6*d*), in this case arranged in a straight line along the lateral. development of the connecting surface 26.

Figure 10C:
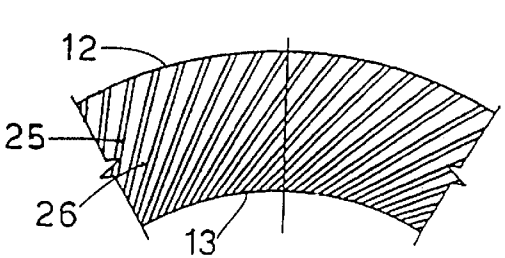
FIGS. 10*a*, 10*b* and 10*c* show other surface sections of the rollers according to the invention.
Figure 10B:
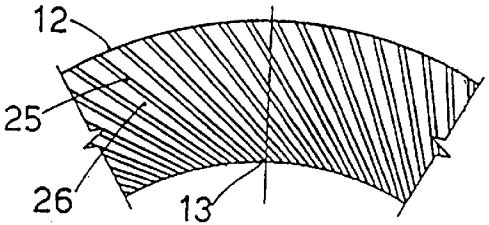

In the variants shown in FIGS. 10*b* and 10*c,* the parallelepipedon or prism-shaped raised parts 25 are helically inclined, respectively left-hand or right-hand, with respect to the lateral development of the connecting surfaces 26.

The relative side walls of these parallelepipedon or prism-shaped raised parts 25 are arranged substantially at a right angle to the plane defined by the connecting surfaces 26, or tapered with the tip facing outwards.

In the embodiment shown in FIGS. 7*a*–7*d,* on the connecting surfaces 26 between the peaks 12 and the grooves 13 there are hollows or bevels 23 of a substantially oblong shape.

In the preferred embodiment of the invention, the depth of the hollows/bevels 23 is defined as "q", which is in the range of 1/15 and 1/300 of the outer diameter "d" of the roller 11, the length is "r", between 1/120 and 1/8 and the width is "t", between 1/150 and 1/20 of the outer diameter "d".

Figure 10A:
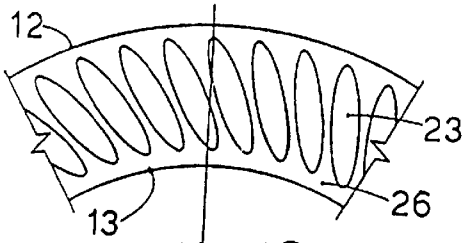

The oblong hollows/bevels 23 can be substantially parallel to the axis 11*a* of the roller 11, or they can be sloping with respect to the axis 11*a* (see the profile in FIG. 10*a*) in one direction or the other.

Figure 8B:
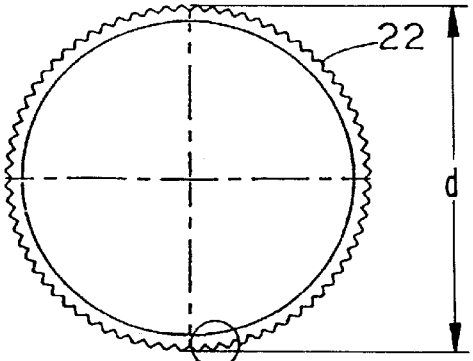
FIG. 8*b* shows a side view of a roller in FIG. 8*a;*
Figure 8C:
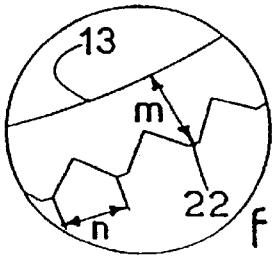
FIG. 8*c* shows the detail G in FIG. 8*b;*
Figure 8A:
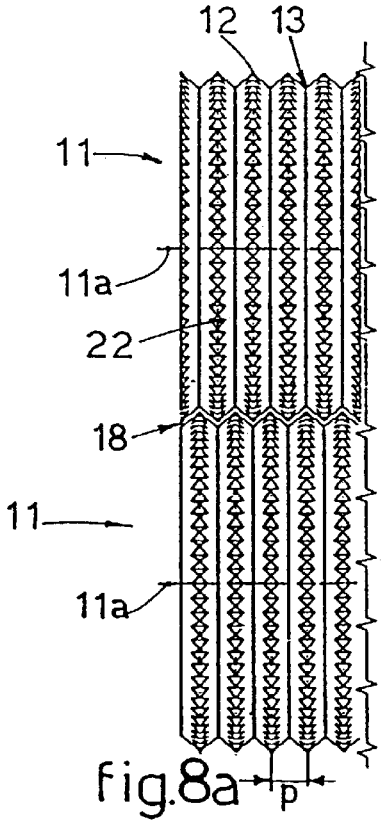
FIG. 8*a* shows a further variant of FIG. 5*a;*

In the embodiment shown in FIGS. 8*a*–8*c*, in cooperation with each peak 12, and lengthwise to it, there are protrusions and/or protuberances 22, in this case substantially pyramid-shaped with a square base.

According to a variant which is not shown here, the protrusions 22 are prism-shaped.

The protrusions/protuberances 22, in this case, have a height "m" (FIG. 8*c*) with respect to the base of the groove 13 inside a range of 1/50 and 1/5 of the outer diameter "d" of the relative roller 11. The distance "n" between the tips of the adjacent protrusions/protuberances 22 is inside a range of 1/50 and 1/10 of the diameter "d" of the relative roller 11.

It is possible to achieve other, different profiles of the protrusions/protuberances, or of the hollows on the connecting surfaces 26 between the peaks 12 and the grooves 13, still remaining within the field of the invention.

What is claimed is:

1. A roller device to separate particles of wood or material similar to wood having different gradings from a loose mass in the form of chips, shavings, granules or fibres, the device being able to be employed in separating and screening machines or machines to form layers, and comprising a plurality of rotary rollers disposed with the axes parallel therebetween to define a selection bed, the loose mass being able to advance in a direction substantially at a right angle to the axes of the rollers, each roller having a cylindrical surface shaped to define a plurality of circumferential and sharp peaks disposed side by side to define a plurality of circumferential and V-shaped grooves, said peaks and grooves being arranged substantially parallel to the axis of the selection bed, characterised in that the rollers have at least a working position wherein the peaks of one roller are faced to and deeply penetrated in the V-shaped grooves of the adjacent roller to define a discharge gap for selecting the particles between two adjacent rollers with a substantially zig-zag development, wherein each segment of said discharge gap is inclined with respect to the axes of said rollers, that in at least some of the rollers, the connecting lateral surfaces between the peaks and the grooves are provided with at least protuberances, protrusions, hollows or facets for vibrating the loose mass, so that said zig-zag discharge gap is at least laterally uneven, even if its width is substantially constant.

2. The roller device as in claim 1, in which the grooves and the peaks are at least rounded or filleted.

3. The roller device as in claim 1, in which the connecting lateral surfaces between the peaks and the grooves are provided with at least one of hollows and facets which face towards the inside of the roller.

4. The roller device as in claim 3, in which the at least one of hollows and facets are oblong in shape.

5. The roller device as in claim 1, in which the connecting lateral surface between the peaks and the grooves are provided with protrusions or protuberances which face towards the outside of the roller.

6. The roller device as in claim 5, in which the protrusions or protuberances are pyramid-shaped and are arranged along generation lines with a helical or radial development.

7. The roller device as in claim 5, in which the protrusions or protuberances consist of parallelepipedon or prism-shaped raised parts with side walls substantially orthogonal or tapered with respect to the plane of the connecting surface.

8. The roller device as in claim 7, in which the parallelepipedon or prism-shaped raised parts are arranged along one or more circumferential orders in an orthogonal direction with respect to the lateral development of the connecting surface.

9. The roller device as in claim 7, in which the parallelepipedon or prism-shaped raised parts are arranged along one or more circumferential orders in a helical direction with respect to the lateral development of the connecting surface.

10. The roller device as in claim 1, in which there are protrusions or protuberances in cooperation with the peaks or the grooves of each roller.

11. The roller device as in claim 10, in which the protrusions or protuberances are pyramid-shaped.

12. The roller device as in claim 10, in which the protrusions or protuberances are prism-shaped.

13. The roller device as in claim 1, in which the bed of rollers may be angled with respect to the horizontal plane by a value of up to ±30°.

14. The roller device as in any claim 1, in which at least when it is employed as a screen, it cooperates with at least a terminal section of the type including disks (28) keyed onto a disk-bearing shaft.

15. The roller device as in claim 1, in which at least the distance between the centre of each pair of adjacent rollers or disk-bearing shafts can be adjusted and modified even during the operating cycle.

16. The roller device as in claim 1, in which at least the vertical position of one roller with respect to the adjacent roller can be adjusted and modified even during the operating cycle.

17. Forming machine for forming mats of particles of different layers, each layer having its own range of particle sizes, the forming machine including at least two roller devices with the characteristics as claim 1, the machine being characterised in that the at least two roller devices are arranged on defined and different horizontal planes or levels, each of the roller devices including its own programmed value for the size of the discharge gap, the discharge gap being different from that of the roller device above and/or below, the discharge gap of each of the roller devices being substantially constant for all the relative adjacent rollers.

* * * * *